US009216502B2

(12) United States Patent
Brendel et al.

(10) Patent No.: US 9,216,502 B2
(45) Date of Patent: Dec. 22, 2015

(54) MULTI-STRANDED RETURN SPRING FOR FASTENING TOOL

(71) Applicant: BLACK & DECKER INC., Newark, DE (US)

(72) Inventors: Lee Michael Brendel, Bel Air, MD (US); Paul G. Gross, White Marsh, MD (US)

(73) Assignee: BLACK & DECKER INC., Newark, DE (US)

( * ) Notice: Subject to any disclaimer, the term of this patent is extended or adjusted under 35 U.S.C. 154(b) by 471 days.

(21) Appl. No.: 13/796,648

(22) Filed: Mar. 12, 2013

(65) Prior Publication Data

US 2013/0233903 A1 Sep. 12, 2013

Related U.S. Application Data

(63) Continuation-in-part of application No. 12/417,242, filed on Apr. 2, 2009, now Pat. No. 8,345,527.

(60) Provisional application No. 61/709,587, filed on Oct. 4, 2012, provisional application No. 61/041,946, filed on Apr. 3, 2008.

(51) Int. Cl.

| | |
|---|---|
| ***B25C 1/06*** | (2006.01) |
| ***B25C 5/15*** | (2006.01) |
| ***B25C 5/00*** | (2006.01) |

(52) U.S. Cl.

CPC ... *B25C 1/06* (2013.01); *B25C 5/00* (2013.01); *B25C 5/15* (2013.01)

(58) Field of Classification Search

CPC ..... B25C 1/00; B25C 1/06; B25C 3/00; B25C 5/00; B25C 5/15

USPC ..... 227/2, 8, 120, 129, 131, 132, 134; 173/202, 203, 205, 122, 124, 210, 211; 267/148, 162, 166

See application file for complete search history.

(56) References Cited

U.S. PATENT DOCUMENTS

| | | | |
|---|---|---|---|
| 1,945,892 | A | 2/1934 | Gobin |
| 2,069,042 | A | 1/1937 | Marchant |
| 2,593,715 | A | 4/1952 | Adler |
| 2,852,424 | A | 9/1958 | Reinhart |
| 3,305,156 | A | 2/1967 | Khan |
| 3,378,426 | A | 4/1968 | Medney |

(Continued)

FOREIGN PATENT DOCUMENTS

| | | | |
|---|---|---|---|
| EP | 2127818 | A1 | 12/2009 |
| EP | 2230050 | A1 | 9/2010 |
| EP | 2374577 | A2 | 10/2011 |

*Primary Examiner* — Scott A. Smith

(74) *Attorney, Agent, or Firm* — Harness, Dickey & Pierce, P.L.C.

(57) ABSTRACT

Compression return springs can be mounted on rails between the driver and an impact absorber. The springs include a plurality of wires twisted together to form a multi-stranded twisted wire member, which forms the coils of the spring. The springs can have an inner diameter that resists movement of the coils along the rails when the spring is at its free length, but has a mounted inner diameter that freely allows such movement. The coil-to-coil pitch of the spring can vary along its length. A motor initially rotates the flywheel without engaging the driver. The driver then contacts the rotating flywheel to propel the driver, which compresses the return springs against the impact absorbers as the driver travels from the returned position to the extended position.

21 Claims, 7 Drawing Sheets

(56) References Cited

U.S. PATENT DOCUMENTS

| | | | | |
|---|---|---|---|---|
| 3,500,940 | A | 3/1970 | Guest | |
| 3,768,577 | A | 10/1973 | Leoni | |
| 3,854,537 | A | 12/1974 | Nelmark et al. | |
| 3,891,036 | A | 6/1975 | Schmidt | |
| 3,930,297 | A | 1/1976 | Potucek et al. | |
| 3,937,286 | A | 2/1976 | Wagner | |
| 4,042,036 | A | 8/1977 | Smith et al. | |
| 4,121,745 | A | 10/1978 | Smith et al. | |
| 4,129,240 | A | 12/1978 | Geist | |
| 4,189,080 | A | 2/1980 | Smith et al. | |
| 4,204,622 | A | 5/1980 | Smith et al. | |
| 4,215,808 | A | 8/1980 | Sollberger et al. | |
| 4,323,127 | A | 4/1982 | Cunningham | |
| 4,434,121 | A | 2/1984 | Schäper | |
| 4,473,217 | A | 9/1984 | Hashimoto | |
| 4,519,535 | A | 5/1985 | Crutcher | |
| 4,530,454 | A | 7/1985 | Gloor et al. | |
| 4,544,090 | A | 10/1985 | Warman et al. | |
| 4,558,747 | A | 12/1985 | Cunningham | |
| 4,721,170 | A | 1/1988 | Rees | |
| 4,724,992 | A | 2/1988 | Ohmori | |
| 4,756,602 | A | 7/1988 | Southwell et al. | |
| 4,773,633 | A | 9/1988 | Hinz et al. | |
| 4,928,868 | A | 5/1990 | Kerrigan | |
| 4,938,297 | A | 7/1990 | Schmidt et al. | |
| 4,964,558 | A | 10/1990 | Crutcher et al. | |
| 5,069,379 | A | 12/1991 | Kerrigan | |
| 5,088,566 | A | 2/1992 | Gustafsson et al. | |
| 5,098,004 | A | 3/1992 | Kerrigan | |
| 5,199,627 | A | 4/1993 | Christensen | |
| 5,343,962 | A | 9/1994 | Daigle et al. | |
| 5,445,227 | A | 8/1995 | Heppner | |
| 5,511,715 | A | 4/1996 | Crutcher et al. | |
| 5,802,691 | A | 9/1998 | Zoltaszek | |
| 5,975,217 | A | 11/1999 | Frenzel et al. | |
| 5,992,541 | A | 11/1999 | Frenzel et al. | |
| 6,000,477 | A | 12/1999 | Campling et al. | |
| 6,068,250 | A | 5/2000 | Hawkins et al. | |
| 6,315,059 | B1 | 11/2001 | Geldean | |
| 6,454,251 | B1 | 9/2002 | Fish | |
| 6,607,111 | B2 | 8/2003 | Garvis et al. | |
| 6,669,072 | B2 | 12/2003 | Burke et al. | |
| 6,729,522 | B2 | 5/2004 | Hempfling et al. | |
| 6,889,591 | B2 | 5/2005 | Sabates et al. | |
| 7,204,403 | B2 | 4/2007 | Kenney et al. | |
| 7,252,157 | B2 | 8/2007 | Aoki | |
| 7,267,257 | B2 | 9/2007 | Erhardt et al. | |
| 7,275,673 | B2 | 10/2007 | Zahner et al. | |
| 7,494,037 | B2 | 2/2009 | Simonelli et al. | |
| 7,503,401 | B2 | 3/2009 | Gross et al. | |
| 7,556,184 | B2 | 7/2009 | Brendel et al. | |
| 7,575,141 | B1 | 8/2009 | Liang et al. | |
| 7,575,142 | B2 | 8/2009 | Liang et al. | |
| 7,789,169 | B2 | 9/2010 | Berry et al. | |
| 8,142,365 | B2 | 3/2012 | Miller | |
| 8,302,833 | B2 | 11/2012 | Gross et al. | |
| 8,511,532 | B2 * | 8/2013 | Chien et al. | 227/133 |
| 8,534,527 | B2 * | 9/2013 | Brendel et al. | 227/132 |
| 8,939,342 | B2 * | 1/2015 | Brendel et al. | 227/134 |
| 2002/0003045 | A1 | 1/2002 | Bongers-Ambrosius | |
| 2002/0108993 | A1 | 8/2002 | Harper et al. | |
| 2002/0108994 | A1 | 8/2002 | Burke et al. | |
| 2002/0108995 | A1 | 8/2002 | Hempfling et al. | |
| 2002/0185288 | A1 | 12/2002 | Hanke et al. | |
| 2003/0221847 | A1 | 12/2003 | Funfer | |
| 2005/0072584 | A1 | 4/2005 | Dresig et al. | |
| 2005/0218177 | A1 | 10/2005 | Berry et al. | |
| 2005/0218178 | A1 | 10/2005 | Berry et al. | |
| 2005/0218182 | A1 | 10/2005 | Berry et al. | |
| 2005/0218183 | A1 | 10/2005 | Berry et al. | |
| 2006/0076154 | A1 | 4/2006 | Aoki | |
| 2006/0175373 | A1 | 8/2006 | Erhardt et al. | |
| 2007/0102471 | A1 | 5/2007 | Gross et al. | |
| 2008/0048000 | A1 | 2/2008 | Simonelli et al. | |
| 2008/0105725 | A1 | 5/2008 | Tamura et al. | |
| 2008/0185164 | A1 | 8/2008 | Amherd | |
| 2008/0217040 | A1 | 9/2008 | Loeffler et al. | |
| 2008/0302852 | A1 | 12/2008 | Brendel et al. | |
| 2009/0223691 | A1 | 9/2009 | Ikuta et al. | |
| 2009/0236387 | A1 | 9/2009 | Simonelli et al. | |
| 2009/0250500 | A1 | 10/2009 | Brendel et al. | |
| 2009/0294504 | A1 | 12/2009 | Kunz et al. | |
| 2009/0294505 | A1 | 12/2009 | Kunz et al. | |
| 2010/0175903 | A1 | 7/2010 | Ikuta et al. | |
| 2010/0187280 | A1 | 7/2010 | Akiba et al. | |
| 2011/0259937 | A1 | 10/2011 | Chien et al. | |
| 2012/0097729 | A1 | 4/2012 | Gross et al. | |

* cited by examiner

MULTI-STRANDED RETURN SPRING FOR FASTENING TOOL

CROSS-REFERENCE TO RELATED APPLICATIONS

This application is a continuation-in-part of U.S. patent application Ser. No. 12/417,242 filed on Apr. 2, 2009, now U.S. Pat. No. 8,534,527 which claims the benefit of U.S. Provisional Application No. 61/041,946 filed Apr. 3, 2008. This application also claims the benefit of U.S. Provisional Application No. 61/709,587, filed on Oct. 4, 2012. The entire disclosures of each of the above applications are incorporated herein by reference.

INTRODUCTION

This section provides information related to the present disclosure which is not necessarily prior art.

The present disclosure relates to return springs for a driver profile on a fastening tool, such as a cordless nailer.

A driver profile of a cordless nailer is typically returned by an elastic cord (or rubber band-type) member. The use of compression springs to return the driver profile of a fastening tool, such as a cordless nailer, presents many difficulties. Such compression return springs experience extremely high dynamic loading forces as the profile is accelerated and decelerated in driving a nail. For example, in some cases a driver profile can accelerate from zero to 23 meters per second in about 4 milliseconds. As a result, return springs of such a driver profile generate problematic surge velocity waves which are highly detrimental to a desired long fatigue life of the springs.

SUMMARY

This section provides a general summary of the disclosure, and is not a comprehensive disclosure of its full scope or all of its features.

In one aspect of the present disclosure, a fastener driving tool is provided. The fastener driving tool includes a driver having a returned position and an extended position. A compression return spring is disposed between the driver and an impact absorber to bias the driver into the returned position. The compression return spring includes a plurality of wires twisted together to form a multi-stranded twisted wire member. The multi-stranded twisted wire member forms a plurality of coils of the compression return spring. A motor is coupled to a flywheel to rotate the flywheel without engaging the driver. The driver is configured to contact the rotating flywheel to propel the driver from the returned position to the extended position. The driver compresses the return spring against the impact absorber as the driver travels from the returned position to the extended position.

In another aspect of the present disclosure, a fastener driving tool is provided including a rail having an outer periphery at an outer rail diameter. A driver is mounted on the rail and movable along the rail between a returned position and an extended position. An impact absorber is mounted on the rail. A compression return spring is mounted on the rail disposed between the driver and the impact absorber to bias the driver into the returned position. The compression return spring includes a plurality of wires twisted together forming a multi-stranded twisted wire member. The multi-stranded twisted wire member forms a plurality of coils of the compression return spring. The coils have a free length inner diameter that is essentially equal to the outer rail diameter causing the coils to resist moving axially along the rail. The coils also have a mounted length inner diameter providing clearance between the inner diameter of the coils and the outer diameter of the rail to allow the coils to freely move axially along the rail as the driver moves between the return and extended positions. A motor is coupled to a flywheel to rotate the flywheel without engaging the driver. The driver and the rotating flywheel are configured to engage each other to propel the driver from the returned position to the extended position. The driver compresses the return spring against the impact absorber as the driver travels from the returned position to the extended position.

In yet another aspect of the present disclosure, a fastener driving tool is provided. The fastener driving tool includes a frame defining a rotational axis and a driver axis. A motor is coupled to the frame and a flywheel is operably coupled to the motor to be rotatably driven by the motor about the rotational axis. A pair of rails extends parallel to the driver axis and the rails are disposed on opposite sides of the flywheel. A driver is mounted on the rails to be movable along the driver axis between a returned position and an extended position. A pair of impact absorbers is included and each of the impact absorbers is mounted coaxially on an associated one of the rails. A pair of springs is included and each of the springs is received over a corresponding one of the rails and disposed between the driver and a corresponding one of the impact absorbers. The springs cooperate to bias the driver into the returned position. Each of the springs includes a plurality of wires twisted together to form a multi-stranded twisted wire member. The multi-stranded twisted wire member forms a plurality of coils of the spring. The driver is configured to contact the rotating flywheel to propel the driver from the returned position to the extended position. The driver compresses the springs against the impact absorber as the driver travels from the returned position to the extended position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
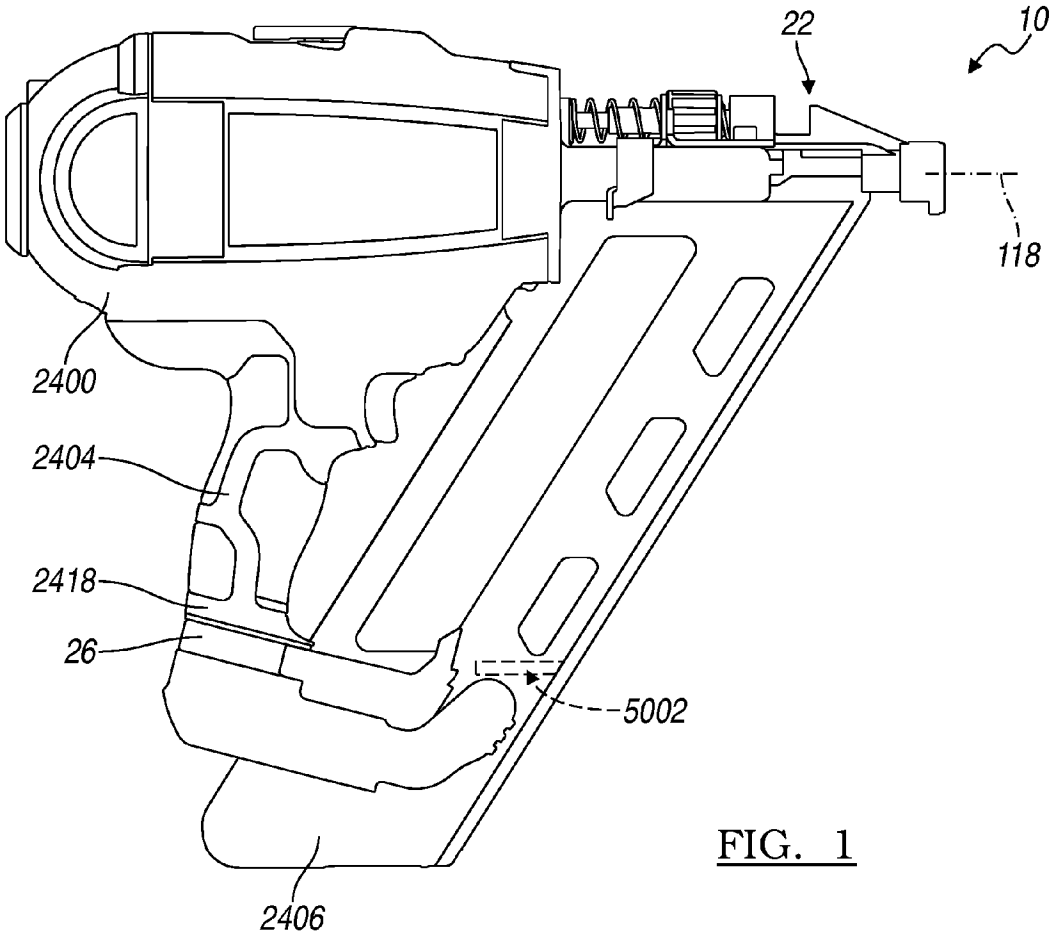
FIG. 1 is a side elevation view of an exemplary driving tool constructed in accordance with the teachings of the present disclosure.
Figure 2:
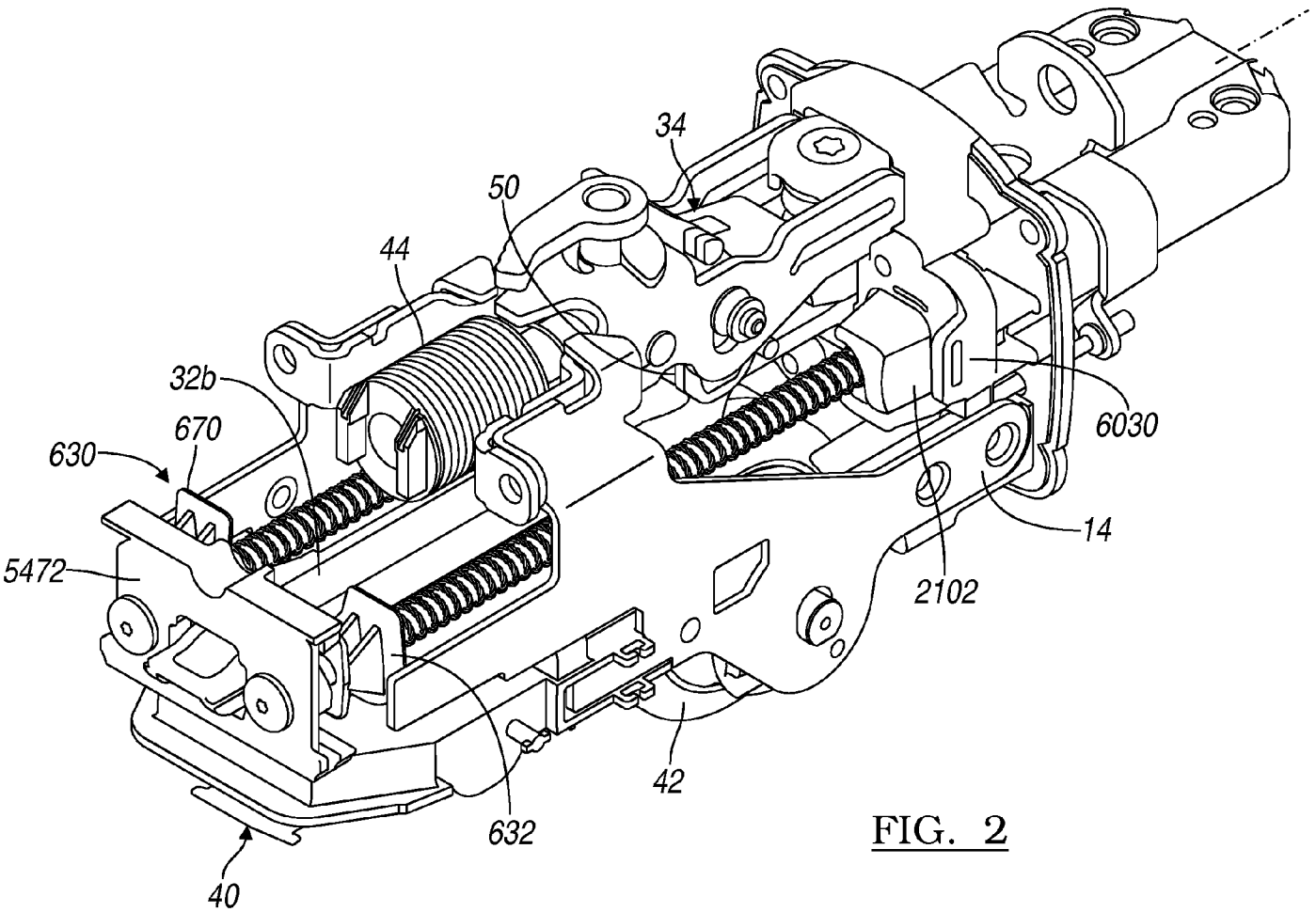
FIG. 2 is a perspective view of a portion of interior components of the driving tool of FIG. 1.
Figure 3:
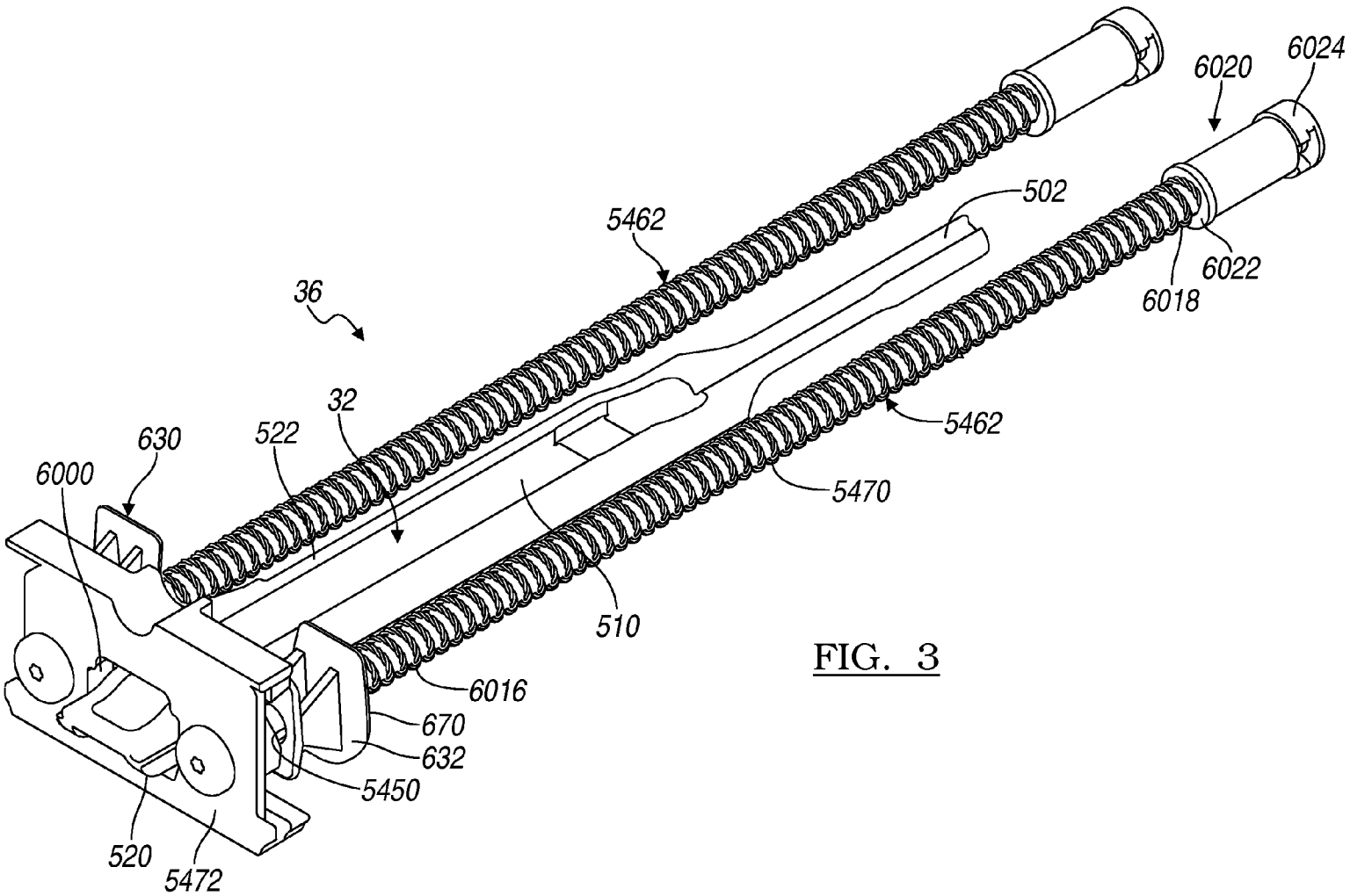
FIG. 3 is a perspective view of various driver and return mechanism components of FIG. 2 in greater detail.
Figure 4:
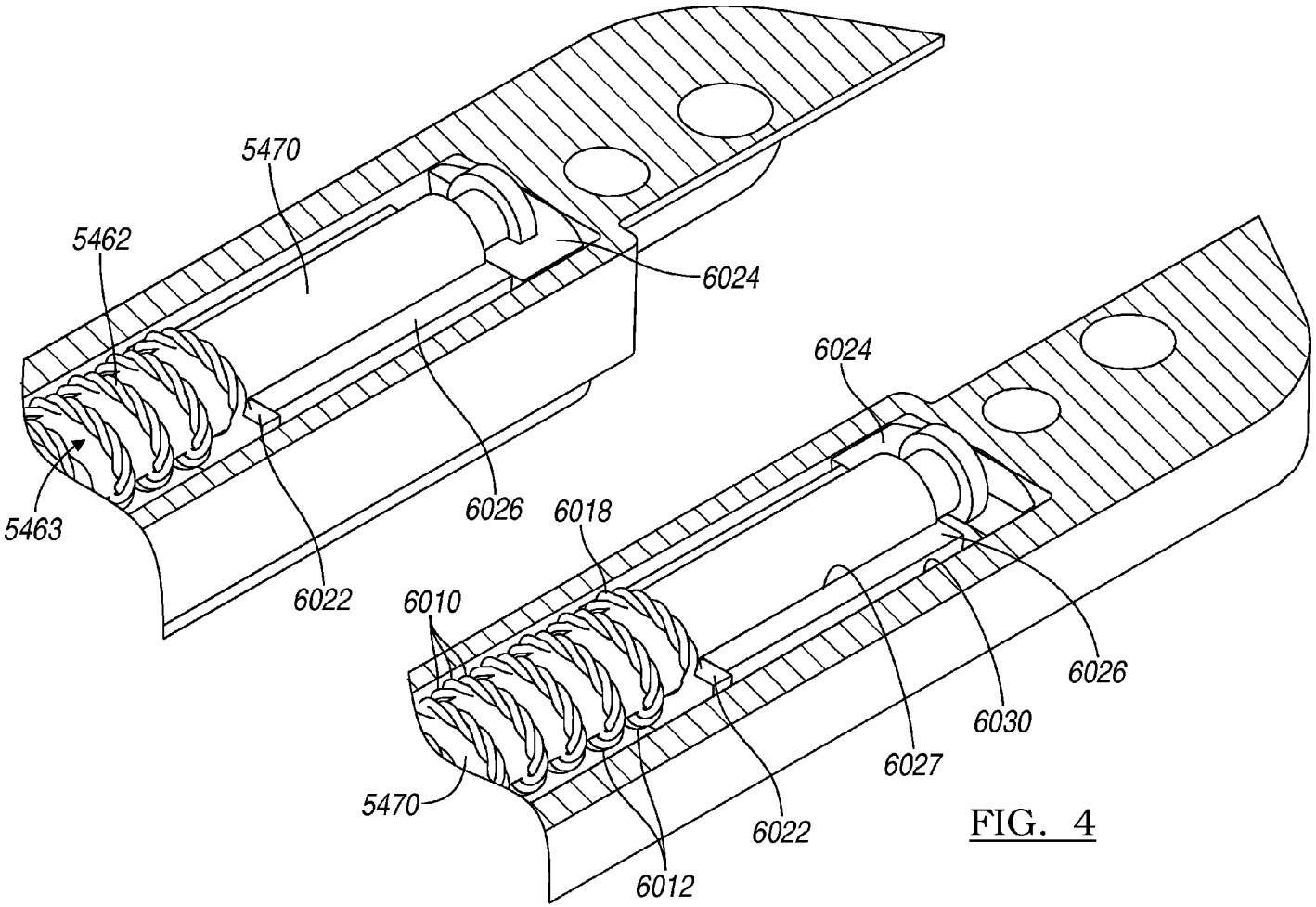
FIG. 4 is an enlarged perspective, partial cross-sectional view showing the ends of rails in pockets.

Example embodiments will now be described more fully with reference to the accompanying drawings. While the fastening tool 10 is illustrated as being electrically powered by a suitable power source, such as the battery pack 26, those skilled in the art will appreciate that the invention, in its broader aspects, may be constructed somewhat differently and that aspects of the present invention may have applicability to pneumatically powered fastening tools. Furthermore, while aspects of the present invention are described herein and illustrated in the accompanying drawings in the context of a nailer, those of ordinary skill in the art will appreciate that the invention, in its broadest aspects, has further applicability. For example, the drive motor assembly may also be employed in various other mechanisms that utilize reciprocating motion, including rotary hammers, hole forming tools, such as punches, and riveting tools, such as those that install deformation rivets.

Referring to FIGS. 1-4 of the drawings, a driving tool 10 generally comprises a backbone or frame 14 supported within a housing 2400. Housing 2400 includes a magazine portion 2406 including a pusher assembly 5002 for positioning fasteners F in line with a driver 32. Housing 2400 also includes a handle portion 2404, and mount 2418 for coupling a battery 26 to housing 2400.

A motor 40 is coupled to frame 14 and in driving engagement with a flywheel 42. For example, the motor 40 can be an outer rotor brushless motor where the flywheel 42 is an integral part of the outer rotor. Alternatively, motor 40 can be drivingly coupled to flywheel 42 via a transmission (not shown). Thus, motor 40 is employed to drive the flywheel 42, while the actuator 44 is employed to move a follower 50 that is associated with the follower assembly 34, which squeezes the driver 32 into engagement with the flywheel 42 so that energy may be transferred from the flywheel 42 to the driver 32 to cause the driver 32 to translate from a returned position to an extended position.

During operation of the driving tool 10, the follower 50 is driven into contact with the cam profile 522 of the driver 32 and urges the driver 32 downwardly toward the flywheel 42. The rails 5470 can move toward the flywheel 42 in response to the force applied by the follower 50 to permit the driver profile 520 of the driver 32 to engage the flywheel 42. Thus, the driver 32, including profiles 520 and 522 and driver blade 502 can drive a fastener F.

More specifically, the follower 50, which can be a roller, can be coupled to the backbone or frame 14, and can be moved via the actuator 44 between a first position, in which the follower 50 drives the driver 32 into the rotating perimeter of the flywheel 42 to transfer energy from the flywheel 42 to the driver 32 to propel the driver 32 along the driver axis 118, and a second position in which the follower 50, the driver 50 and the flywheel 42 are not engaged to one another. The nosepiece assembly 22 guides the fastener F as it is being driven into the workpiece. The return mechanism 36 biases the driver 32 into a returned position.

The driver 32 can be configured to include a pair of projections 512. The projections 512 can extend from the opposite lateral sides of the body 510 and can include return anchors 630 (i.e., points at which the driver 32 is coupled to the return mechanism 36) and bumper tabs 632 which include contact surfaces 670 that are configured to contact a lower bumper 2102 that can be received into a pocket formed into the nosepiece assembly 22. Each of the return anchors 630 can define an anchor hole 5450, which can extend through an associated one of the projections 512 generally parallel to the driver blade 502. The contact surfaces 670 can be shaped in a desired manner, but are flat in the particular example provided.

The return mechanism 36 can include a rail assembly 5460 and a pair of compression springs 5462. The rail assembly 5460 can include a pair of rails 5470 and an end cap 5472 that can be coupled to an upper end of the rails 5470. The rails 5470 can be formed of a low friction material, such as hardened steel, and can be received through the anchor holes 5450 and employed to guide the driver 32 when the driver 32 is moved to the returned position. The end cap 5472 can include an aperture 6000 through which the driver 32 can either extend or be accessed by an upper bumper (not shown), which is coupled to the backbone or frame 14 of the driving tool 10, when the driver 32 is moved to the returned position. It will be appreciated that the upper bumper can include an energy absorbing member so as to dampen the impact forces transmitted to the backbone 14 and tool assembly when the driver 32 is moved to the returned position.

The compression springs 5462 can be configured to provide a relatively long fatigue life in spite of the dynamic loading that they will experience. For example, the compression springs 5462 can be formed of several wires 6010 that can be twisted about one another to form a multi-stranded twisted wire member 5463. The multi-stranded twisted wire member 53 is coiled in a helical manner and forms the coils 6012 of the compression return spring 5462. For example, each compression spring 5462 can be formed of three wires formed of 0.018 inch diameter M4 music wire that can be twisted together at a rate of nine (9) turns per inch. As another example, the lay of the multi-stranded twisted wire member 53 can be from about 4 mm to about 7 mm. As yet another example, the lay of the multi-stranded twisted wire member 53 can be about 5 mm.

The compression springs 5462 can be received coaxially over the rails 5470 on an end opposite the end cap 5472 and can be abutted against the return anchors 630. The spring 5462 or coils 6012 of the multi-stranded twisted wire member 5463 has a free length inner diameter. This refers to the diameter when the spring 5462 is at its free length; meaning the spring 5462 is not being compressed or stretched. In other words, the spring 5462 is resting at its free or natural length.

The free length diameter of the spring 5462 or coils 6012 can be essentially equal to the outer diameter of the rail 5470 upon which it is mounted (including slightly larger but), causing the coils 6012 of the spring 5462 to resist freely moving axially along the rail 5470 (when the spring 5462 is at its free length). The spring 5462 or coils 6012 can also have a mounted length diameter which is the diameter of the spring 5462 or coils 6012 at the length of the spring 5462 when it is mounted on the rail 5470. The mounted length of the spring 5462 is shorter than the free length of the spring 5462. The mounted length diameter of the spring 5462 or the coils 6012 can provide sufficient clearance between the inner diameter of the coils 6012 and the outer diameter of the rail 5470 to allow the coils 6012 to freely move axially along the rail 5470 as the driver moves between the return and extended positions.

In the particular example provided, the compression springs 5462 have ground ends and as such, the return anchors 630 have a flat surface 670 against which the compression springs 5462 are abutted. It will be appreciated, however, that other configurations could be employed in the alternative (e.g., the compression springs 5462 could have open or closed ends that are not ground and the surface of the return anchors 630 can be at least partly contoured in a helical manner to matingly engage the unground ends of the compression springs 5462).

It is believed that the multi-stranded member 5463 of the springs 5462 can reduce the stress on each wire strand of the spring 5462. It is also believed that the interaction of the twisted strands of the multi-stranded member 5463 against each other provides some beneficial frictional dampening. It is additionally believed that the multiple strands tend to hold each other together, reducing the tendency of the spring diameter to increase under repeated impact. It is believed this tendency can be further reduced by providing the spring with the free length and mounted length inner diameter discussed above by providing improved alignment of the coils of the spring as they impact each other. Thus, one or more of the above can result in significantly longer fatigue life of the springs 5462.

Impact absorbers 6020 can be employed in conjunction with the compression springs 5462 to further protect the compression springs 5462 from fatigue. In the particular example provided, the impact absorbers 6020 include first and second planar annular isolation members 6022 and 6024, respectively and a damper 6026 that can be disposed between the first and second isolation members 6022 and 6024.

Each of the first and second impact structures 6022 and 6024 can be formed of a suitable rigid impact-resistant material, such as glass-filled nylon or hardened steel, which can be directly contacted by the compression springs 5462. The damper 6026 can be formed of a suitable impact absorbing material, such as chlorobutyl rubber.

The impact absorbers 6020 can be sleeve-like structures that can be fitted coaxially over an associated one of the rails 5470 between the second end 6018 of the compression springs 5462 and the backbone or frame 14. Alternatively or additionally, the impact absorbers 6020 can be fixed to the rail 5470. For example, the damper 6026 can be an open celled foam having a central aperture 6027 for receiving the corresponding rail 5470 upon which it is mounted. Similar to the discussion above, the central aperture 6027 of the damper 6026 can have a free state inner diameter, which is the diameter when the damper 6026 is not being stretched or compressed. The free state diameter of the central aperture 6027 can be smaller than the outer diameter of the corresponding rail 5470 upon which it is mounted. Thus, the aperture 6027 is in a stretched state when it is mounted on the rail 5470.

The backbone 14 or nosepiece 22 can be configured with pockets 6030 to at least partly receive the impact absorbers 6020, but it will be appreciated that the pockets 6030 and impact absorbers 6020 are not configured to cooperate to maintain the rails 5470 in a fixed, non-movable orientation relative to the backbone 14. Rather, the rails 5470 are provided with a degree of movement (toward and away from the flywheel 42). Configuration in this manner permits the driver 32 to be guided during its travel from the returned position to the extended position by the nosepiece 22 of the driving tool 10 rather than by the rails 5470. It will be appreciated from the foregoing that the nosepiece 22 can include an aperture (not shown) that is shaped and sized to correspond to a cross-sectional shape and size of the driver blade 502.

Referring to FIGS. 5-8, an alternative backbone or frame 14 and related internal components for a driving tool 10 is illustrated. The various elements described herein that are generally similar in structure and function are identified by the same reference numbers as are used in FIGS. 1-4. As such, these components and their operation is apparent from the above discussion and is not repeated here.

For present purposes, one distinction relates to the compression springs 5462*b*, which can be configured with multiple coil pitches (i.e., the distance between adjacent coils 6012*b* of the compression spring 5462*b*). At least two different coil pitches can be employed to define each of the compression springs 5462*b*. Each compression spring 5462*b* can employ a first coil pitch at a first end 6016*b*, which in this case is abutted against the return anchor 630*b*, and a second coil pitch at a second end 6018*b* opposite the first end 6016*b*. The coil pitch can vary between the first and second ends and for example, can become progressively smaller with decreasing distance to the second end. For example, the compression springs 5462*b* can be formed of 0.028 inch M4 music wire, the first coil pitch can be 3.00 mm and the second coil pitch can be 1.20 mm.

Configuring the variable coil pitch as illustrated (with the large coil pitch adjacent end cap 6472*b* and the small coil pitch near the impact absorber 6020*b*) can offer certain benefits. For example, due to the rapid acceleration of the driver 32, the coils 6012*b* of the spring 5462*b* can have a tendency to initially compress adjacent the first end 6016*b* creating a more or less solid coil mass. This coil column or mass can be detrimental to the fatigue life of the springs 5462*b* as a result of it crashing down on the coils at the second end 6018*b* adjacent the impact absorber 6020. Providing a large coil pitch can reduce this coil mass, thereby benefiting the fatigue life of the springs 5462*b*.

Figure 5:
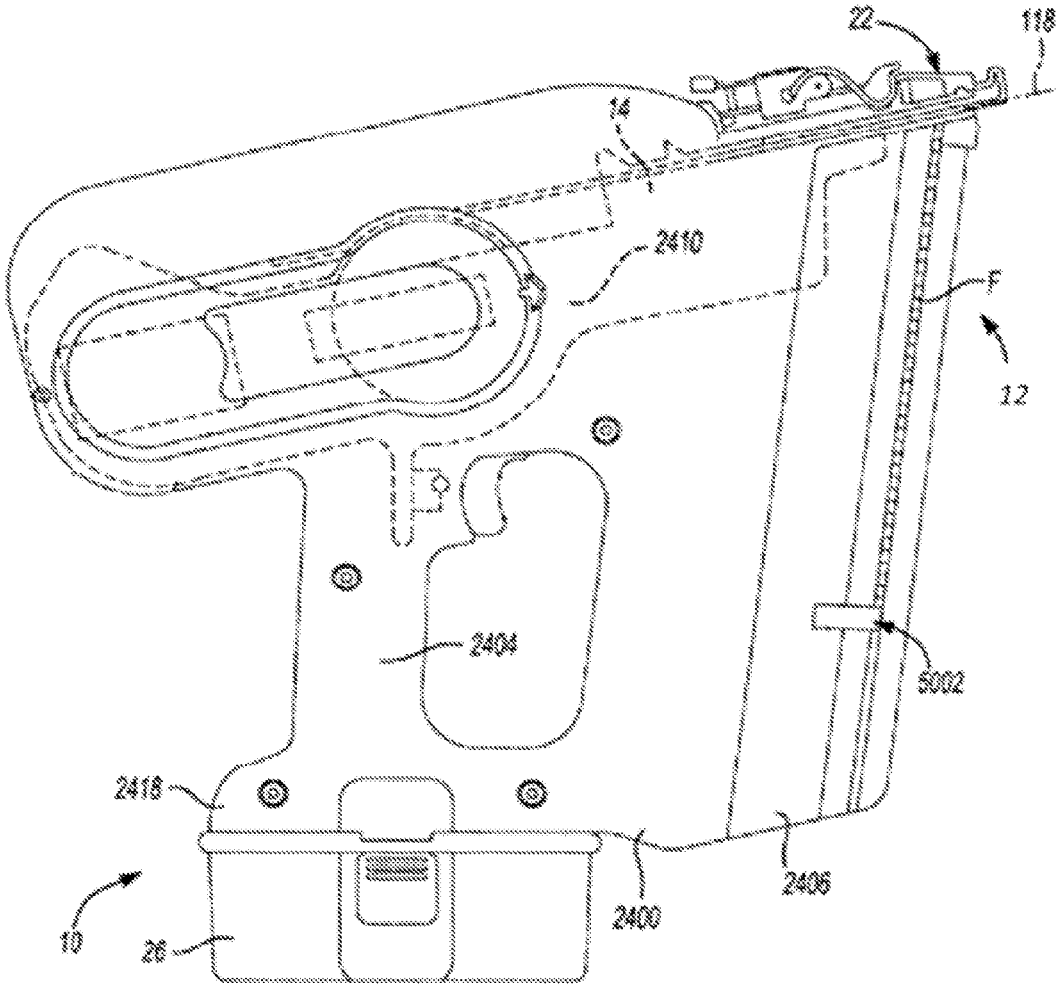
FIG. 5 is a side elevation view of another exemplary driving tool constructed in accordance with the teachings of the present disclosure
Figure 6:
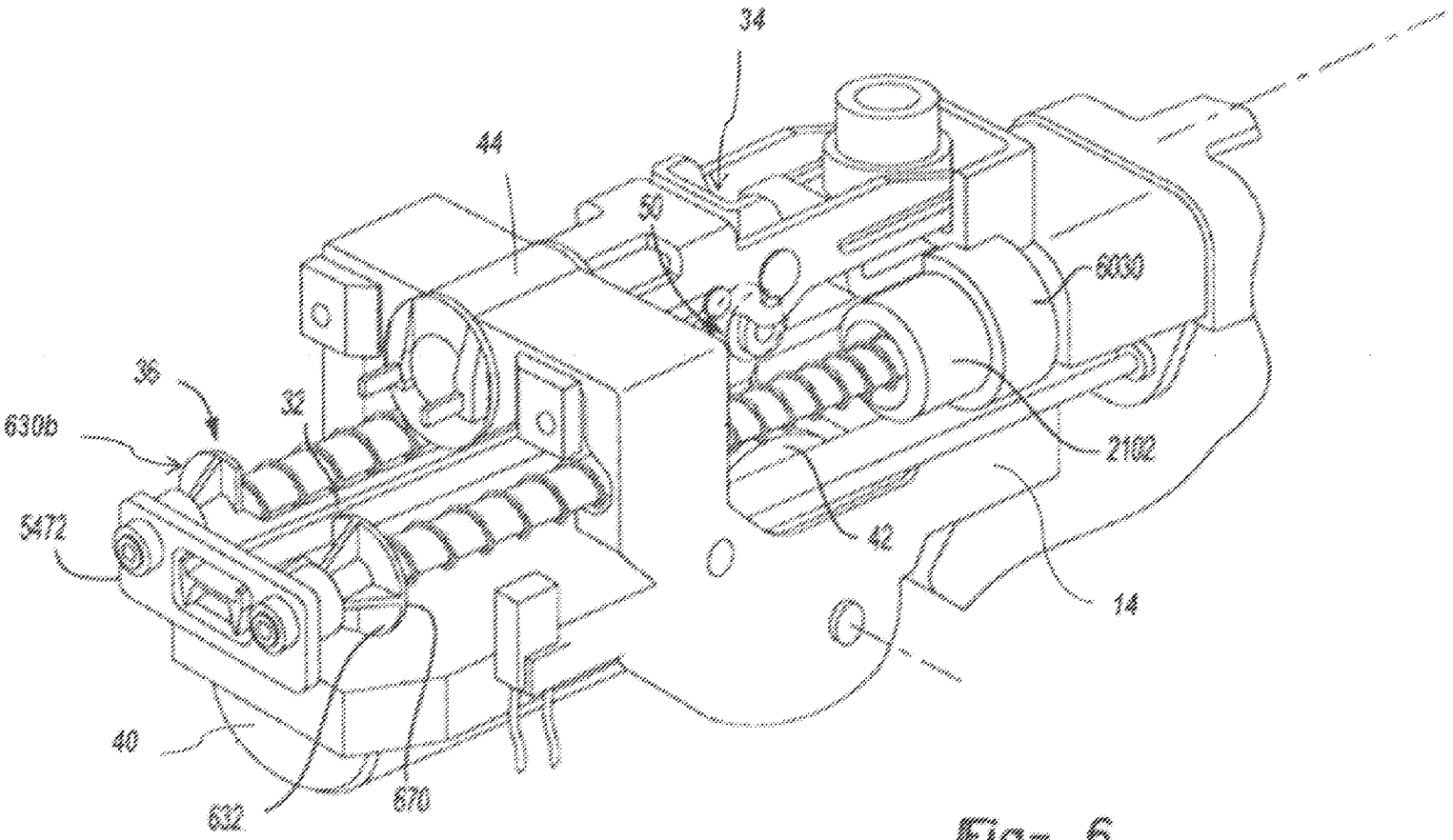
FIG. 6 is a perspective view of a portion of interior components of the driving tool of FIG. 1.
Figures 7, 8:
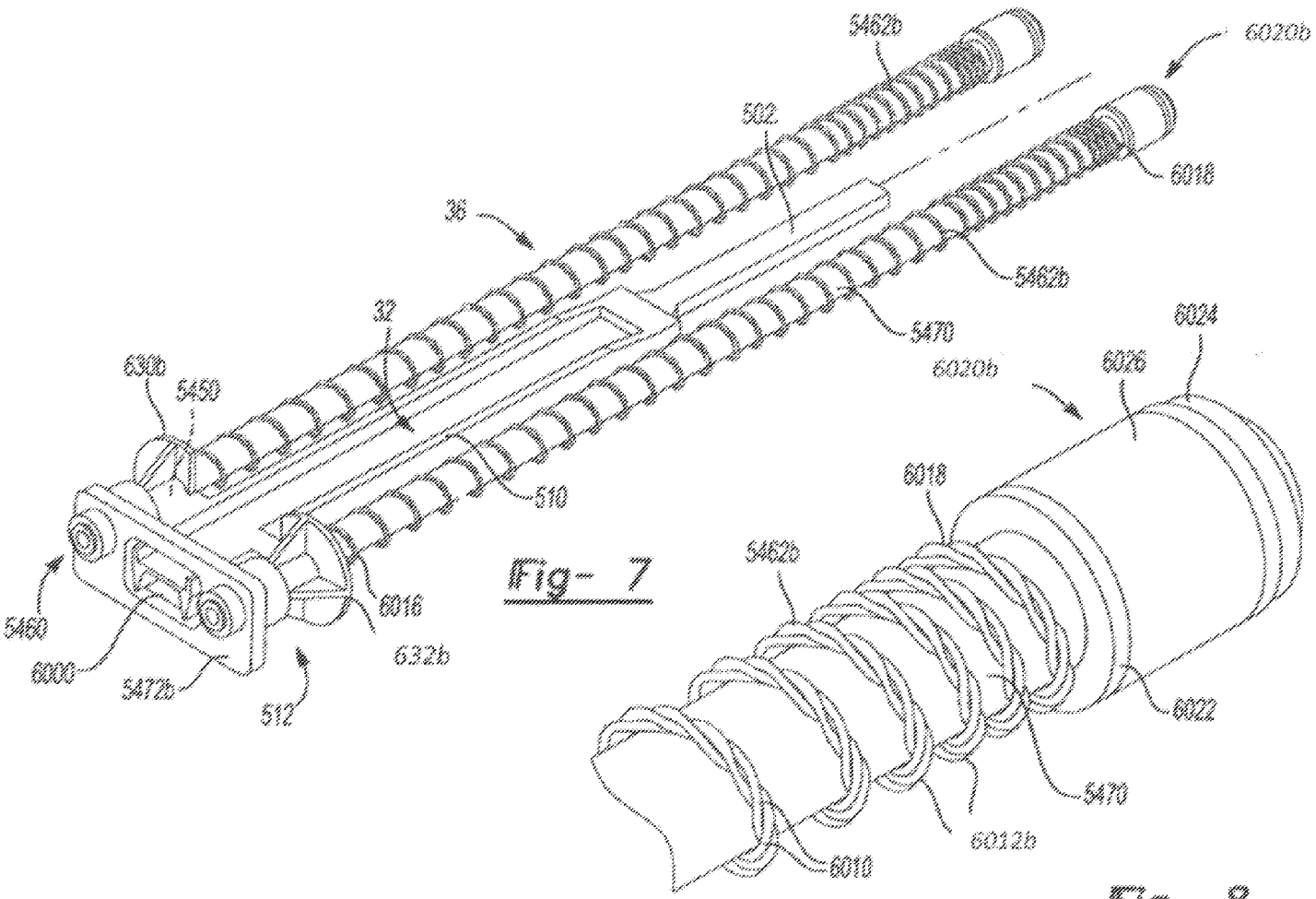
FIG. 7 is a perspective view of various driver and return mechanism components of FIG. 6 in greater detail.
FIG. 8 is an enlarged portion of FIG. 7.

Reversing the direction of the pitch from that illustrated in FIGS. 5-7 (with the small coil pitch adjacent end cap 6472*b* and the large coil pitch near the impact absorber 6020*b*) can also offer certain benefits. For example, such a configuration can reduce the stress on the springs 5462*b* during the rapid initial compression at the first end 6016*b*, which can also benefit the fatigue life of the springs 5462*b*. This configuration may be particularly beneficial, for example, with multi-stranded return springs 6462*b* that are better able to withstand the impact of the coil column mass (than single stranded springs) at the second end 6018*b*.

It will be appreciated that the above description is merely exemplary in nature and is not intended to limit the present disclosure, its application or uses. While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein, even if not specifically shown or described, so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out the teachings of the present disclosure, but that the scope of the present disclosure will include any embodiments falling within the foregoing description and the appended claims.

What is claimed is:

1. A fastener driving tool comprising:

a driver having a returned position and an extended position;

a compression return spring being disposed between the driver and an impact absorber to bias the driver into the returned position, the compression return spring comprising a plurality of wires twisted together forming a multi-stranded twisted wire member, the multi-stranded twisted wire member forming a plurality of coils of the compression return spring;

a motor in driving engagement with a flywheel to rotate the flywheel without engaging the driver;

wherein the driver is configured to contact the rotating flywheel to propel the driver from the returned position to the extended position; and wherein the driver compresses the return spring against the impact absorber as the driver travels from the returned position to the extended position.

2. The fastener driving tool of claim 1, wherein the multi-stranded twisted wire member comprises at least three wires.

3. The fastener driving tool of claim 1, wherein the multi-stranded twisted wire member comprises a lay of between about 4 mm and about 7 mm.

4. The fastener driving tool of claim 1, wherein the impact absorber comprises a closed celled foam.

5. The fastener driving tool of claim 1, wherein the impact absorber comprises an open celled foam.

6. The fastener driving tool of claim 5, wherein the impact absorber further comprises an isolation member interposed between an end of the compression return spring member and the impact absorber.

7. The fastener driving tool of claim 1, wherein the compression return spring has a first coil-to-coil pitch adjacent an end that is smaller than a second coil-to-coil pitch adjacent an opposite end of the compression return spring.

8. A fastener driving tool comprising:

a rail having an outer periphery at an outer rail diameter;

a driver mounted on the rail and movable along the rail between a returned position and an extended position;

an impact absorber mounted on the rail;

a compression return spring mounted on the rail disposed between the driver and the impact absorber to bias the driver into the returned position, the compression return spring comprising a plurality of wires twisted together forming a multi-stranded twisted wire member, the multi-stranded twisted wire member forming a plurality of coils of the compression return spring, the coils having a free length inner diameter that is essentially equal to the outer rail diameter causing the coils to resist moving axially along the rail, and having a mounted length inner diameter providing clearance between the inner diameter of the coils and the outer diameter of the rail to allow the coils to freely move axially along the rail as the driver moves between the return and extended positions; and a motor in driving engagement with a flywheel to rotate the flywheel without engaging the driver;

wherein the driver and the rotating flywheel are configured to engage each other to propel the driver from the returned position to the extended position; and wherein the driver compresses the return spring against the impact absorber as the driver travels from the returned position to the extended position.

9. The fastener driving tool of claim 8, wherein the multi-stranded twisted wire member comprises at least three wires.

10. The fastener driving tool of claim 8, wherein the impact absorber comprises a closed celled foam.

11. The fastener driving tool of claim 8, wherein the impact absorber comprises an open celled foam.

12. The fastener driving tool of claim 11, wherein the impact absorber further comprises an isolation member interposed between an end of the compression return spring member and the impact absorber.

13. The fastener driving tool of claim 8, wherein the compression return spring has a first coil-to-coil pitch adjacent an end that is smaller than a second coil-to-coil pitch adjacent an opposite end of the compression return spring.

14. A fastener driving tool comprising:

a frame defining a rotational axis and a driver axis;

a motor coupled to the frame;

a flywheel rotatably driven by the motor about the rotational axis;

a pair of rails extending parallel to the driver axis, the rails being disposed on opposite sides of the flywheel;

a driver mounted on the rails to be movable along the driver axis between a returned position and an extended position;

a pair of impact absorbers, each of the impact absorbers being mounted coaxially on an associated one of the rails;

a pair of springs, each of the springs being received over a corresponding one of the rails disposed between the driver and a corresponding one of the impact absorbers, the springs cooperating to bias the driver into the returned position, each of the springs comprising a plurality of wires twisted together forming a multi-stranded twisted wire member, the multi-stranded twisted wire member forming a plurality of coils of the spring;

wherein the driver is configured to contact the rotating flywheel to propel the driver from the returned position to the extended position; and wherein the driver compresses the return spring against the impact absorber as the driver travels from the returned position to the extended position.

15. The fastener driving tool of claim 14, wherein a follower is coupled to the frame and movable between a first position, in which the follower drives the driver into engagement with the flywheel to transfer energy from the flywheel to the driver to propel the driver relative to the flywheel along the driver axis, and a second position in which the follower, the driver and the flywheel are not engaged to one another.

16. The fastener driving tool of claim 14, wherein the coils have a free length inner diameter that is essentially equal to the outer rail diameter causing the coils to resist moving axially along the rail, and having a mounted length inner diameter providing clearance between the inner diameter of the coils and the outer diameter of the rail to allow the coils to freely move axially along the rail as the driver moves between the return and extended positions.

17. The fastener driving tool of claim 14, wherein the multi-stranded twisted wire member comprises at least three wires.

18. The fastener driving tool of claim 14, wherein the impact absorber comprises a closed celled foam member.

19. The fastener driving tool of claim 14, wherein the impact absorber comprises an open celled foam member.

20. The fastener driving tool of claim 19, wherein the impact absorber further comprises an isolation member mounted on the rail and interposed between an end of the compression return spring member and the impact absorber.

21. The fastener driving tool of claim 14, wherein the compression return spring has a first coil-to-coil pitch adjacent an end that is smaller than a second coil-to-coil pitch adjacent an opposite end of the compression return spring.

* * * * *

UNITED STATES PATENT AND TRADEMARK OFFICE

CERTIFICATE OF CORRECTION

PATENT NO. : 9,216,502 B2
APPLICATION NO. : 13/796648
DATED : December 22, 2015
INVENTOR(S) : Lee Michael Brendel et al.

It is certified that error appears in the above-identified patent and that said Letters Patent is hereby corrected as shown below:

Title Page, Item (63) Related U.S. Application Data,
Line 2, "8,345,527" should be -- 8,534,527 --.

Signed and Sealed this
Twelfth Day of April, 2016

Michelle K. Lee

Michelle K. Lee
*Director of the United States Patent and Trademark Office*